US009572223B1

(12) United States Patent
Mula et al.

(10) Patent No.: US 9,572,223 B1
(45) Date of Patent: Feb. 14, 2017

(54) PRECISION COLOR-CONTROLLED LIGHT SOURCE

(71) Applicant: Hughey & Phillips, LLC, Urbana, OH (US)

(72) Inventors: Richard C. Mula, Westlake Village, CA (US); Steven V. Ricca, Upper Arlington, OH (US)

(73) Assignee: HUGHEY & PHILLIPS, LLC, Urbana, OH (US)

( * ) Notice: Subject to any disclaimer, the term of this patent is extended or adjusted under 35 U.S.C. 154(b) by 0 days.

(21) Appl. No.: 15/154,315

(22) Filed: May 13, 2016

Related U.S. Application Data

(60) Provisional application No. 62/161,496, filed on May 14, 2015.

(51) Int. Cl.
*H05B 41/28* (2006.01)
*H05B 33/08* (2006.01)
*H05B 37/02* (2006.01)

(52) U.S. Cl.
CPC ..... *H05B 33/0866* (2013.01); *H05B 33/0815* (2013.01); *H05B 33/0851* (2013.01); *H05B 33/0884* (2013.01); *H05B 37/0263* (2013.01); *H05B 37/0272* (2013.01)

(58) Field of Classification Search
CPC . H05B 37/02; H05B 37/0245; H05B 33/0845; H05B 33/0818; H05B 33/086; H05B 33/0869; H05B 33/0851; H05B 33/0803; H05B 33/0824; H05B 41/28; H05B 41/2828; H05B 37/029; H05B 37/0272; Y02B 20/341; Y02B 20/342; Y02B 20/347; G09G 2320/043; G09G 2320/0276; G09G 2320/0626
(Continued)

(56) References Cited

U.S. PATENT DOCUMENTS 6,200,002 B1 3/2001 Marshall et al.
6,507,159 B2 1/2003 Muthu
(Continued)

OTHER PUBLICATIONS

Manufacturer Data Sheet, "NCP5623 Triple Output I2C Controlled RGB LED Driver," published by Semiconductor components Industries, LLC, Oct. 2008, Denver, Colorado. All Pages.
(Continued)

*Primary Examiner* — Haissa Philogene
(74) *Attorney, Agent, or Firm* — Michael A. Forhan; James R. Eley; Eley Law Firm Co., LPA

(57) ABSTRACT

A color-controlled light source includes a plurality of light emitting diodes, the light emitting diodes being configured to emit different colors of light, intensity of the light emitted by the light emitting diodes being selectably adjustable. A sensor receives the light emitted by the light emitting diodes and converts the received light to electrical feedback signals corresponding to the emitted light. A processor generates an electrical reference signal. An amplifier receives the reference signal and the feedback signal, compares the feedback signal and the reference signal, and generates an error signal corresponding to a difference between the feedback signal and the reference signal. A current control receives the error signal and adjusts the intensity of at least one light emitting diode to cancel the error signal. A composite color emitted by the plurality of light emitting diodes has a predetermined, closed-loop controlled chromaticity.

20 Claims, 11 Drawing Sheets

(58) Field of Classification Search
USPC ..... 315/149, 158, 224, 291, 307, 308, 312; 345/77, 81, 83, 207, 690, 691
See application file for complete search history.

(56) References Cited

U.S. PATENT DOCUMENTS

| | | | | |
|---|---|---|---|---|
| 7,202,613 | B2 * | 4/2007 | Morgan | A01M 1/04 315/312 |
| 7,948,394 | B2 | 5/2011 | Bergman et al. | |
| 8,022,631 | B2 * | 9/2011 | Roberts | H05B 33/0845 315/117 |
| 8,408,744 | B2 | 4/2013 | Szolyga et al. | |
| 8,456,092 | B2 * | 6/2013 | Knapp | H04L 12/43 315/152 |
| 8,514,210 | B2 * | 8/2013 | Roberts | G09G 3/3426 315/308 |
| 8,638,235 | B2 | 1/2014 | Beiner | |
| 9,179,516 | B2 * | 11/2015 | Meijer | H05B 33/0818 |
| 9,411,083 | B2 | 8/2016 | Angelini et al. | |

OTHER PUBLICATIONS

Manufacturer Data Sheet, "TLC5971 12-Channel, 16-Bit, Enhanced Spectrum, PWM, RGB, LED Driver With 3.3-V Linear Regulator," published by Texas Instruments, Inc., Aug. 2010, Dallas, Texas. All Pages.
Manufacturer Data Sheet, "LTC3212 RGB LED Driver and Charge Pump," published by Linear Technology Corporation, 2007, Milpitas, California. All Pages.
Article, Jason Rich, "Using the Philips Hue Lighting System in Your Home and Controlling It with Your iPhone or iPad," published by Que Publishing, Mar. 20, 2013, Indianapolis, Indiana. All Pages.
Manufacturer Data Sheet, "TCS3103, TCS3104 Light-to-Voltage Color Sensor," published by Texas Advanced Optoelectronic Solutions, Inc., Jul. 2010, Plano, Texas. All Pages.
Manufacturer Data Sheet, "TCS3471 Color Light-to-Digital Converter," published by Texas Advanced Optoelectronic Solutions, Inc., 2011, Plano, Texas. All Pages.
Eric Loader and Michael Giardina, "Multi-Chip/Quad-Lens Fixtures vs. Single-Chip/Single-Lens RGB Fixtures," article published by Acclaim Lighting, Nov. 19, 2013, Los Angeles, California, 5 pages.
Ross Fosler, Cecilia Contenti and Tom Ribarich, "Digitally Addressable DALI Dimming Ballast," article published by Microchip Technology, Inc., 2002, Chandler, Arizona, 18 pages.
Parthiv Pandya, "Using a PICO® Microcontroller for DMX512 Communication," article published by Microchip Technology, Inc., 2007, Chandler, Arizona, 18 pages.
Piero Bianco, "LEDs Allow New Remote-Controlled Lighting Applications," article published by Maxim Integrated Products, Inc., Jun. 27, 2011, San Jose, California, 4 pages.
"Secondary Color Mixing Lens for RGB Edixeon® LEDs," manufacturer data sheet published by Edison Opto Corporation, Nov. 27, 2007, New Taipei City, Taiwan, 5 pages.
"MAX44005 RGB Color, Temperature, and Infrared Proximity Sensor," manufacturer data sheet published by Maxim Integrated Products, Inc., Oct. 2012, San Jose, California, 27 pages.
"Adding Intelligence to Lighting Applications," manufacturer design guide published by Microchip Technology, Inc., Summer 2010, Chandler, Arizona, 20 pages.
"MTCSiCS Integral True Color Sensor," manufacturer data sheet published by MAZeT GmbH, Feb. 15, 2015, Jena, Germany, 12 pages.
Internet Web Page, "RGB Color Codes Chart," http://www.rapidtables.com/web/color/RGB_Color.htm, printed Oct. 1, 2016, 6 pages.
"NCP5623 Triple Output I2C Controlled RGB LED Driver," manufacturer data sheet published by Semiconductor Components Industries, LLC, Oct. 2008, Denver, Colorado, 10 pages.
"TLC5971 12-Channel, 16-Bit, Enhanced Spectrum, PWM, RGB, LED Driver With 3.3-V Linear Regulator," manufacturer data sheet published by Texas Instruments, Inc., Aug. 2010, Dallas, Texas, 37 pages.
"LTC3212 RGB LED Driver and Charge Pump," manufacturer data sheet published by Linear Technology Corporation, 2007, Milpitas, California, 12 pages.
Jason R. Rich, "Using the Philips Hue Lighting System in Your Home and Controlling It with Your iPhone or iPad," article published by Que Publishing, Mar. 20, 2013, Indianapolis, Indiana, 4 pages.
"TCS3103, TCS3104 Light-to-Voltage Color Sensor," manufacturer data sheet published by Texas Advanced Optoelectronic Solutions, Inc., Jul. 2010, Plano, Texas, 12 pages.
"TCS3471 Color Light-to-Digital Converter," manufacturer data sheet published by Texas Advanced Optoelectronic Solutions, Inc., Mar. 2011, Plano, Texas, 22 pages.

* cited by examiner

PRECISION COLOR-CONTROLLED LIGHT SOURCE

CROSS-REFERENCE TO RELATED APPLICATIONS

This application claims priority to U.S. provisional patent application No. 62/161,496, filed May 14, 2015, the entire contents of which is expressly incorporated by reference herein.

FIELD

The present invention relates generally to light sources, in particular to a precision variable-color light source.

BACKGROUND

Airfield lighting is customarily used in the aviation industry to outline and make more visible various portions of an airport, such as runways and taxiways. Depending upon the size of an airport, airfield light fixtures may number in the hundreds or even thousands. As a result, airport operators often spend a great deal of time maintaining airfield lights for compliance with safety and various other requirements. Accordingly, airfield lights can contribute—often substantially—to the overall cost of airport maintenance.

Aviation regulatory agencies have certain minimum standards with respect to the visual characteristics of light provided by various airport runway, taxiway and threshold edge light fixtures, particularly the color of the light emitted by the fixtures. For example, runway edge lights are white in color, except on instrument-approach approved runways where yellow replaces white on the last 600 meters (2,000 feet) or half the runway length, whichever is less, to form a caution zone for landings. The lights marking the ends of the runway emit red light toward the runway to indicate the end of the runway to departing or arriving aircraft and emit green light outward from the runway end to indicate the threshold to landing aircraft. Taxiway lights are designed to emit blue light.

Light sources commonly used in airfield applications include incandescent, halogen, gas-arc and cold-cathode fluorescent types. The color of light emitted by the light source must usually be changed or "shifted" by use of unique optical filters in order to meet regulatory agency color requirements. Changing the color of the light emitted by light fixtures having these types of light sources to another color usually requires changing the optical filters, which can be costly, cumbersome and time-consuming.

More recently, light emitting diodes (LEDs) have become available for use as light sources in airfield lighting. LEDs are typically monochromatic-colored emitters or phosphor-converted white light emitters. Changing the color of light emitted by light fixtures having LEDs typically requires that the LEDs be replaced with ones having the desired colors, and may further require changing of an optical filter.

Regardless of the type of light source, a multitude of expensive spare parts are required to provide the spectrum of aviation colors required by regulatory agencies for the various types of light fixtures. Such a spare parts inventory can place a strain on an airport's maintenance budget as well as consuming valuable storage space. Accordingly, there is a need for a way to reduce the number of spare lighting fixtures that must be held in inventory by airport maintenance departments.

SUMMARY

The present invention includes an LED "light engine" light source comprising multiple LED emitters of various colors. The LED emitters are coupled with active monitoring and control of LEDs' color and temperature to ensure relatively precise radiometric and photometric output. By providing precise, closed-loop, individual amplitude control of each colored LED the projected composite beam color of the light source can be maintained and selectably changed.

In some embodiments of the present invention various operational parameters of the LEDs may be programmed and controlled externally by means of a communications link. For example, a local or remotely-located, computer-based control system may be utilized in conjunction with software or firmware that is configured to control various operating characteristics of the LEDs.

A power supply of the present invention may utilize active, closed-loop feedback and control of the power supplied to the LEDs in order to maintain the requisite color and intensity required by aviation regulatory agencies.

One object of the present invention is a color-controlled light source that includes a plurality of light emitting diodes, the light emitting diodes being configured to emit different colors of light, intensity of the light emitted by the light emitting diodes being selectably adjustable. A sensor receives the light emitted by the light emitting diodes and converts the received light to electrical feedback signals corresponding to the emitted light. A processor generates an electrical reference signal. An amplifier receives the reference signal and the feedback signal, compares the feedback signal and the reference signal, and generates an error signal corresponding to a difference between the feedback signal and the reference signal. A current control receives the error signal and adjusts the intensity of at least one light emitting diode to cancel the error signal. A composite color emitted by the plurality of light emitting diodes has a predetermined, closed-loop controlled chromaticity.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
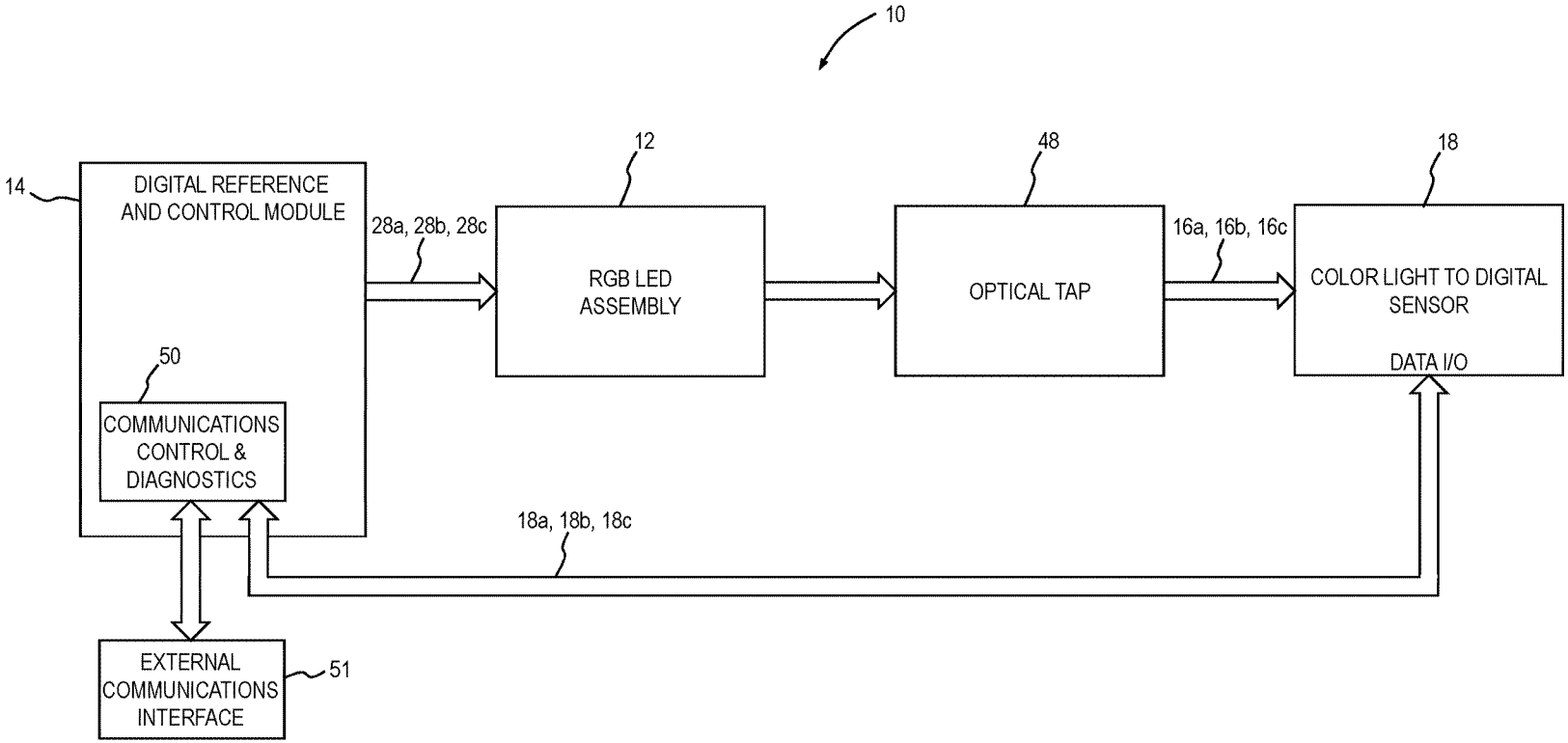
FIG. 1 is a diagram of the general arrangement of an LED light engine according to an embodiment of the present invention.

In the discussion that follows, like reference numerals may be used to describe like functional elements and features in the various drawings.

The general arrangement of a light engine 10 is shown in FIG. 1 through according to an embodiment of the present invention. One or more LEDs 12 primarily having red, green and blue ("RGB") light emitting elements 12*a*, 12*b*, 12*c* respectively are electrically powered by a controller 14. Optionally, LED 12 may further include auxiliary light emitting elements that emit light having other colors such as, for example, yellow and white (see, e.g., auxiliary light emitting elements 12*d*, 12*e*, 12*f* in FIG. 6).

Red, green and blue light 16*a*, 16*b*, 16*c* (FIG. 3) respectively emitted by elements 12*a*, 12*b*, 12*c* respectively is received by a color light to digital sensor 18 (FIG. 4), which converts the received light to corresponding electrical feedback signals 18*a*, 18*b*, 18*c* (FIG. 1) corresponding to the red, green and blue colors of light emissions respectively. An amplifier 20*a* (FIG. 2) of controller 14 compares red feedback signal 18*a* to a predetermined electrical reference signal 22*a* generated by a processor 23 to generate an error signal 24*a* based upon the difference between the two signals. A current control 26*a*, such as a pulse width modulator, receives reference signal 22*a* and error signal 24*a*, and generates a feedback-controlled drive signal 28*a* that is supplied to red light emitting element 12*a* (FIG. 3) via a buffer 30*a*. Similarly, an amplifier 20*b* (FIG. 2) compares green feedback signal 18*b* to a predetermined electrical reference signal 22*b* generated by processor 23 to generate an error signal 24*b* based upon the difference between the two signals. A current control 26*b*, such as a pulse width modulator, receives reference signal 22*b* and error signal 24*b*, and generates a feedback-controlled drive signal 28*b* that is supplied to green light emitting element 12*b* (FIG. 3) via a buffer 30*b*. Likewise, an amplifier 20*c* (FIG. 2) compares blue feedback signal 18*c* to a predetermined electrical reference signal 22*c* generated by processor 23 to generate an error signal 24*c* based upon the difference between the two signals. A current control 26*c*, such as a pulse width modulator, receives reference signal 22*c* and error signal 24*c*, and generates a feedback-controlled drive signal 28*c* that is supplied to blue light emitting element 12*c* (FIG. 3) via a buffer 30*c*. The resulting composite color of LED light emitting elements 12*a*, 12*b*, 12*c* is closed-loop controlled by controller 14 to a predetermined chromaticity.

In industry, some LEDs are characterized for peak radiated power at about 350 mA and/or 1000 mA of drive current, and their performance is typically measured at a relatively constant die temperature of about 25 degrees Centigrade (° C.). Since the amount of light emitted by LEDs drops as die temperature increases, it is important that the junction temperature of LED 12 be maintained at a level that is sufficiently constant to ensure that the lighting fixture meets its requisite performance specifications. Airfield lighting applications typically require that lighting equipment be operable at a minimum ambient temperature upper limit of about 55° C. However, it should be noted that this figure does not take into account impinged solar absorption by the lighting fixture, which can easily boost the fixture's temperature to over 90° C. Accordingly, the present invention preferably includes provisions for controlling the temperature of LED 12.

Figure 2:
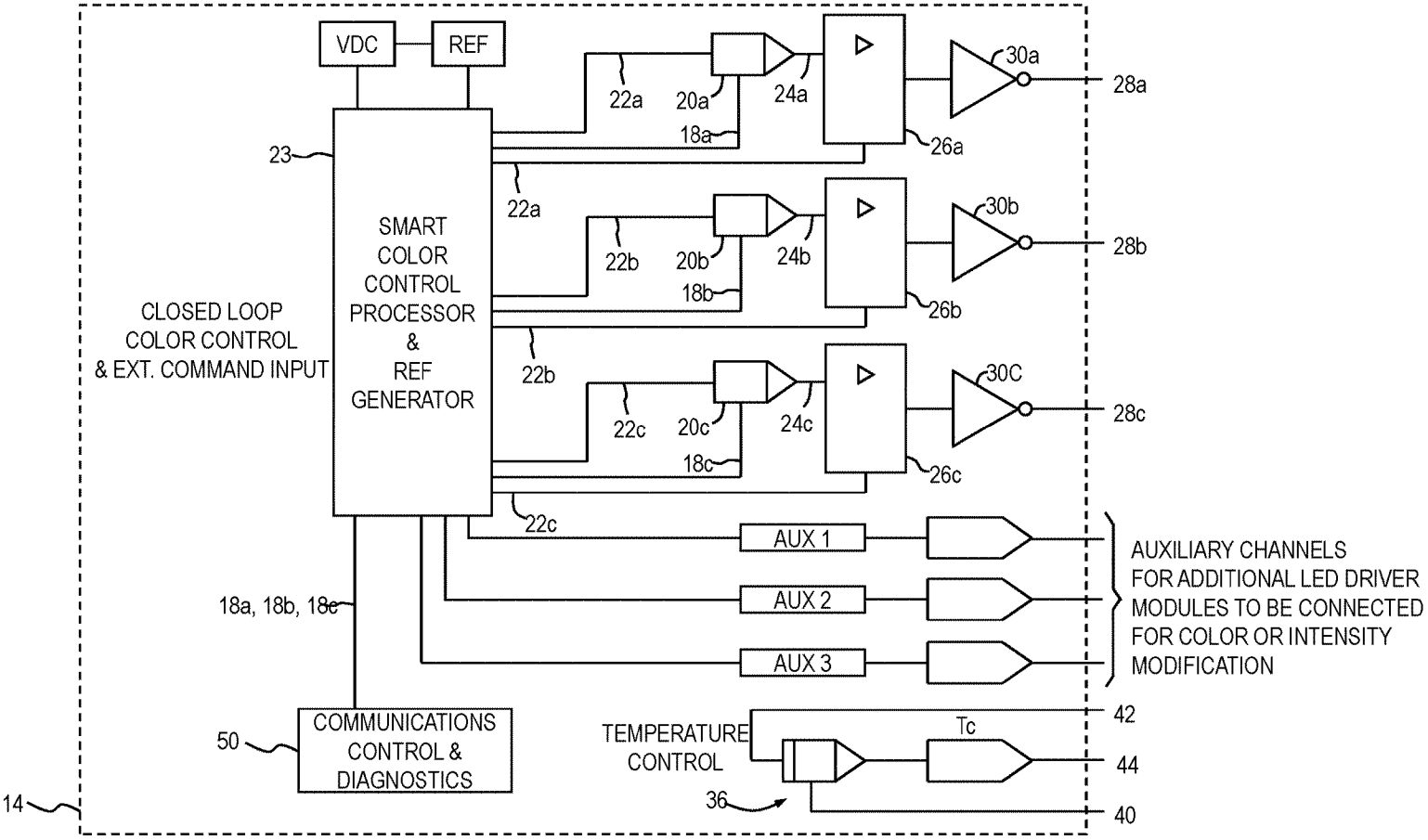
FIG. 2 is a diagram of a controller of the light engine of FIG. 1 according to an embodiment of the present invention.
Figure 3:
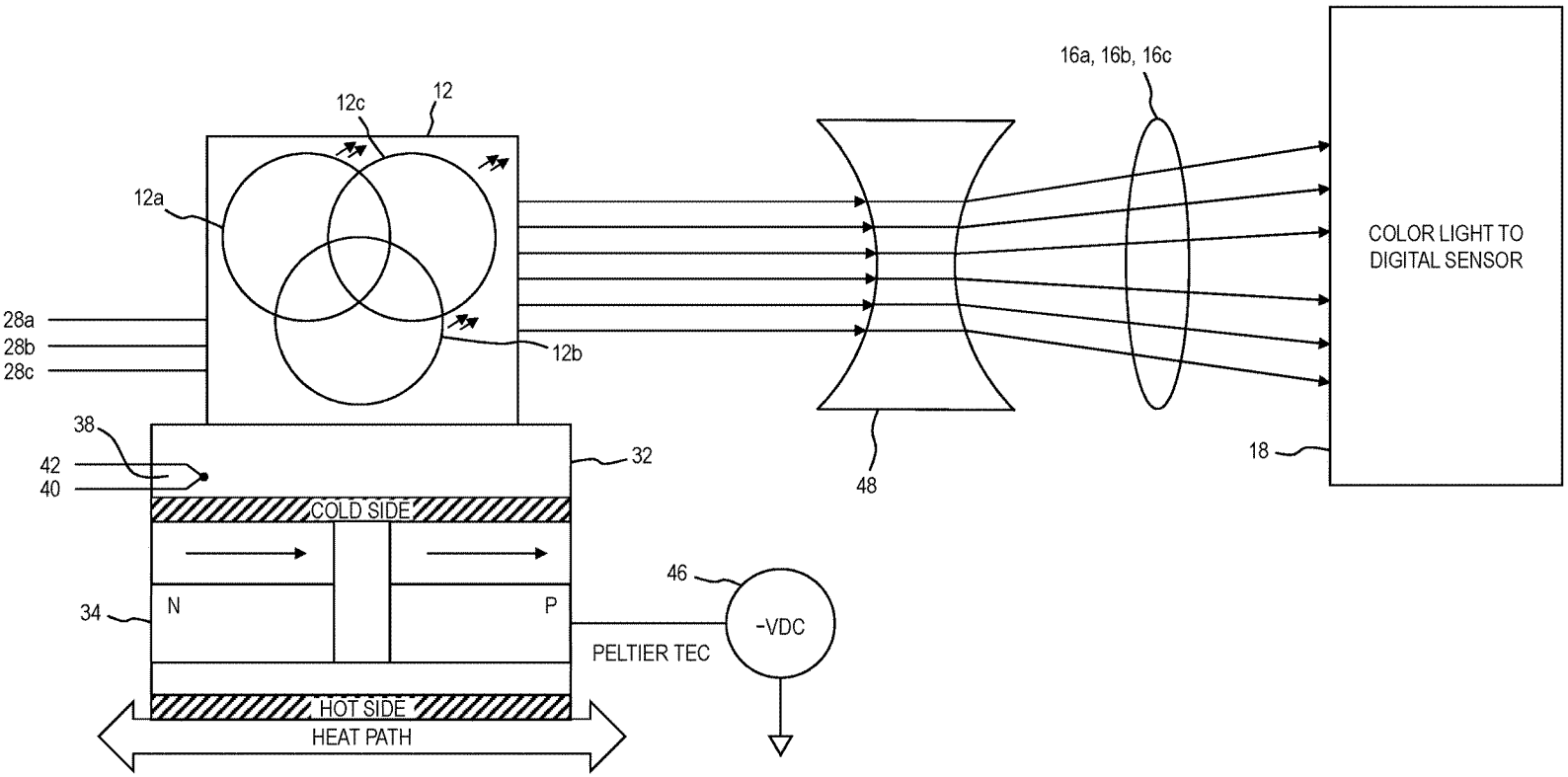
FIG. 3 is a diagram of an LED, cooling device and optical device of the light engine of FIG. 1 according to an embodiment of the present invention.

With reference to FIGS. 2 and 3, cooling of LED 12 may be accomplished by use of a heatsink 32 to remove heat generated by the LED by convection. However, it should be noted that a heatsink alone does not allow the temperature of LED 12 to fall below the ambient temperature. Active control over the temperature of LED 12 may be provided by a Peltier device 34 having a relatively high thermal capacity. Peltier devices have a relatively long service life and lack moving parts, thus requiring no regular maintenance. Peltier devices, also commonly known as thermoelectric cooling (TEC) or thermoelectric module (TEM) devices, also facilitate relatively high heat transfer ratios to achieve a high temperature differential which is useful for maintaining temperature stability of LED 12. Peltier device 34 may also be configured to heat and/or cool LED 12 to maintain its junction temperature within a predetermined range. The thermal design of a lighting fixture incorporating a Peltier device 34 also preferably includes provisions for efficiently discharging the heat removed from LED 12.

Peltier device 34 may serve a dual purpose, namely maintaining a relatively stable temperature for LED 12 and also ducting the excess heat of the LED to an outer case of the fixture and/or to a glass lens of the fixture to melt snow and ice accumulated on the lens.

A temperature regulator 36 (FIG. 2) intermediate controller 14 and Peltier device 34 (FIG. 3) may be utilized for active temperature control of LED 12. Temperature regulator 36 may include a temperature sensing device 38 such as a thermistor having negative temperature coefficient (NTC) or positive temperature coefficient (PTC) characteristics corresponding to the temperature of Peltier device 34 and provides corresponding temperature measurement signals 40, 42 to temperature regulator 36. Temperature regulator 36 evaluates signals 40, 42 and generates output signals 44, 46 to power Peltier device 34 in a closed-loop feedback control arrangement to maintain the temperature of LED 12 proximate a predetermined level. Controller 14 may further include local and/or remote alarms (not shown) to indicate if the temperature of LED 12 falls outside a predetermined temperature range.

It is also desirable to control the temperature of LED 12 in order to maintain relatively consistent power consumption. This is particularly pertinent when gauging the "health" of an LED 12 by measuring a forward voltage ($V_f$) of the LED, or by measuring power consumed by the LED. A normal characteristic of LEDs is that, as the LED gets colder, its $V_f$ rises and the LED consumes more power. The opposite is true as the temperature of LED 12 rises. In the obstruction lighting field, certain light fixtures are required to be monitored for safety purposes and trip an alarm if a fault is detected. The normal excursions of $V_f$ over temperature makes it difficult to monitor large strings of LEDS for faults, since the accumulated $V_f$ voltage changes of the string of LEDs over temperature are much greater in magnitude than voltage changes due to a single LED failure. Maintaining relatively consistent power consumption aids to detect such fault signals.

In some embodiments of the present invention the brightness control of LED 12 by controller 14 may be configured to minimize a "flicker effect" seen when a pulse-width modulated (PWM'ed) LED is viewed through a rotating propeller whose rotational speed is synchronized with the PWM frequency. This synchronization can result in a shutter effect whereby the LED appears to be dimmed or appears as a blinking light, both of which are distracting to flight crews. In one configuration of the present invention the frequency of PWM control for driving LED 12 is set outside the normal range of the rotational speed of aircraft propeller tips. Generally, propeller rotational speeds are limited to keep propeller tips below transonic speeds. Alternatively, LED 12 may be DC current-controlled without PWM. As a non-limiting example, LED 12 and controller 14 may include a buck regulator having a sufficiently high operating frequency that provides regulation of the DC output current to the LED, and may further include a filter network of inductors and capacitors to filter any high-frequency ripple that may be present in the circuit. Preferably, the magnitude of any high-frequency ripple remaining in the output after filtering is sufficiently small and/or the ripple is at a frequency outside the normal range of propeller rotational speeds, thereby reducing or eliminating shutter effect due to synchronization of the ripple frequency with a propeller's rotational speed.

In yet another embodiment of the present invention light engines 10, 100, 200 may include a plurality of LEDs 12, all of the LEDs being illuminated for high-brightness settings. When the system is dimmed a predetermined portion of the LEDs 12 are extinguished while drive current to the remaining LEDs is reduced. This permits pulse width modulation of the remaining LED(s) 12 at greater duty cycles during dimmed operating modes to achieve the same brightness that would be attained by dimming all of the LEDs 12 at a lesser duty cycle, thereby reducing the amount of LED off-time that contributes to the aforementioned shutter effect. This arrangement also reduces undesirable color shifting of LED 12 related to deep dimming.

In still another embodiment of the present invention light engines 10, 100, 200 may include a plurality of LEDs 12 that are segregated into predetermined sections. The sections are operated independently of one another, and are preferably driven such that their PWM ON-OFF duty cycle times are offset or out of phase with one another. The net effect of the light emitted by the LEDs 12 is of a set brightness with little or no shutter effect, since there is little or no period of time when the light engine is not emitting light.

A suitable optical device 48 (FIG. 3), such as a lens, may be provided to receive, concentrate and direct the light generated by LED 12 in a predetermined manner.

Figure 5:
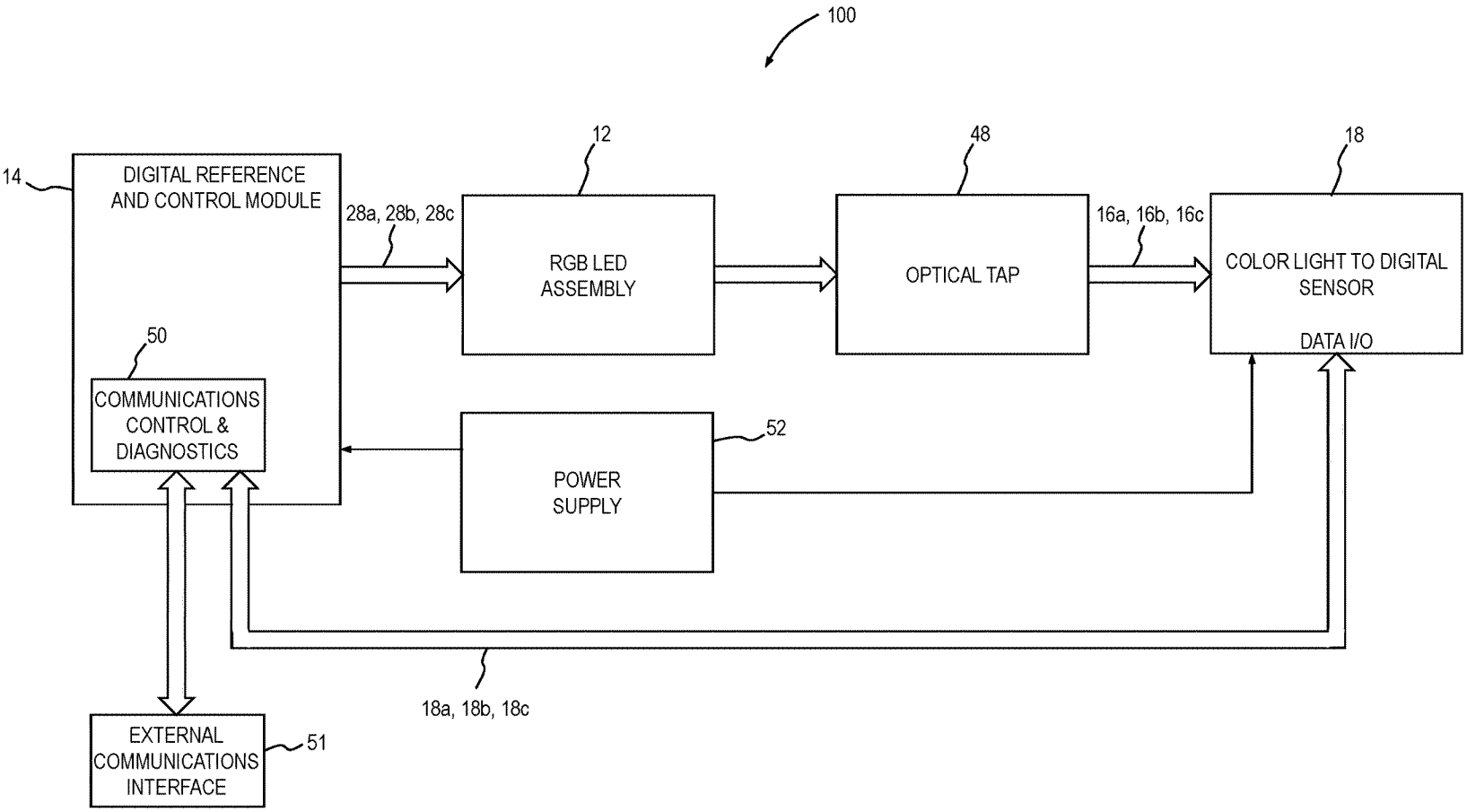
FIG. 5 is a diagram of the general arrangement of an LED light engine according to another embodiment of the present invention.

Controller 14 may further be configured with a communications control 50 (FIGS. 1, 2), which may couple to one or more unidirectional and/or bidirectional communications interfaces 51 (FIG. 5). Example communications interfaces 51 may include, without limitation, wired and wireless networks and the Internet. Communications control 50 may utilize any suitable communications protocols. Communications control 50 may further include security features to deter unauthorized changes to the operational parameters of system 10. Real-time light source control via communications control 50 also allows for dynamic operations and signaling by using specified and dedicated hardware.

Figure 6:
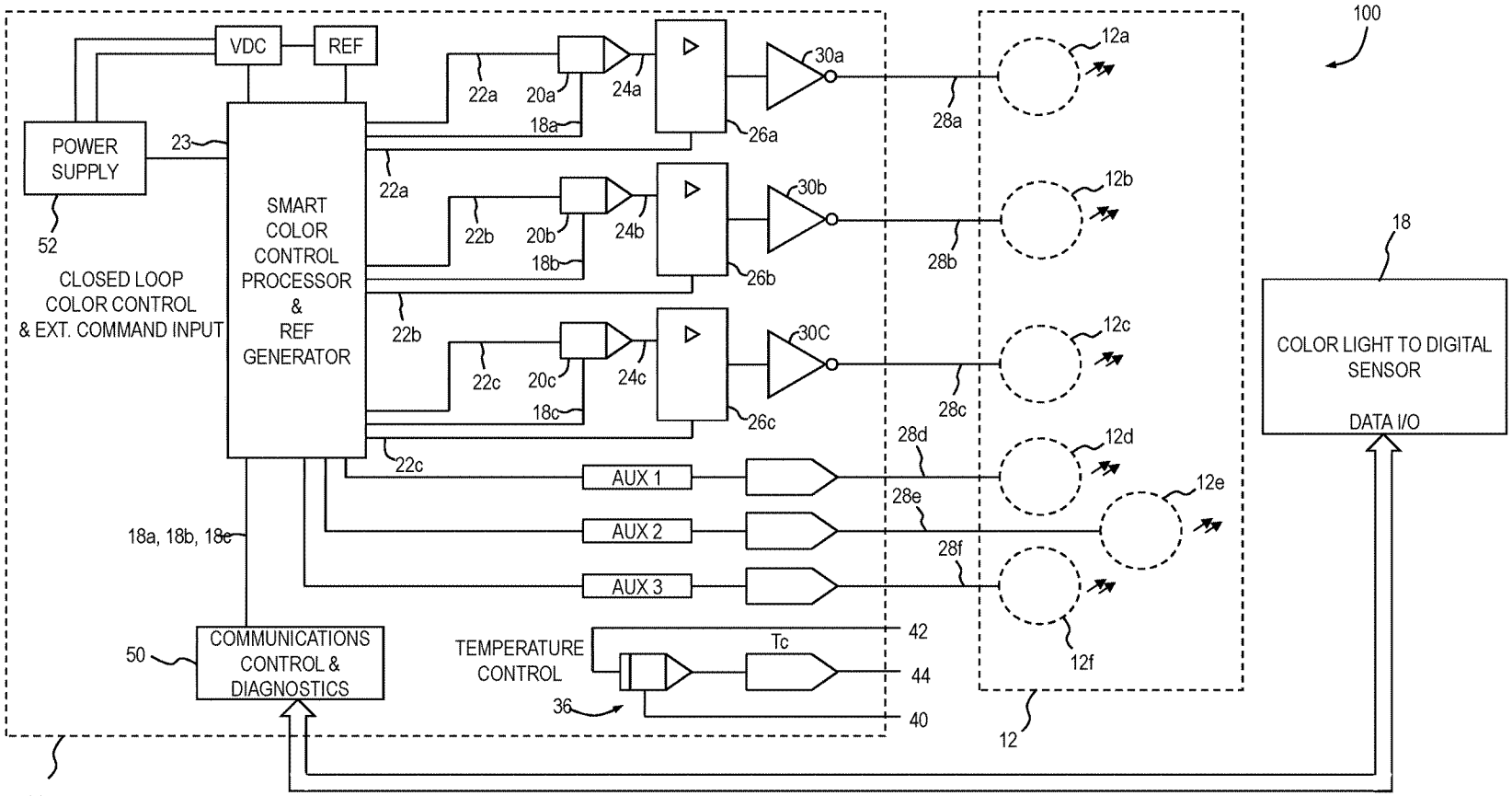
FIG. 6 is a diagram showing further details of the light engine of FIG. 5.

A light engine 100 is shown in FIGS. 5 and 6 according to an embodiment of the present invention. Light engine 100 further includes an electrical power supply 52, which may receive as input power one or more of an alternating current (AC) voltage, direct current (DC) voltage, or constant-current type of power supply and convert the input power to a voltage suitable for providing electrical power to light engine 100. In this arrangement controller 14 may additionally provide multi-channel, digitally-controlled driver circuitry for LED(s) 12. Further features may include active X-Y-Z true color compensation. Light engine 100 may otherwise be configured in a manner similar to light engine 10, detailed above.

Figure 7:
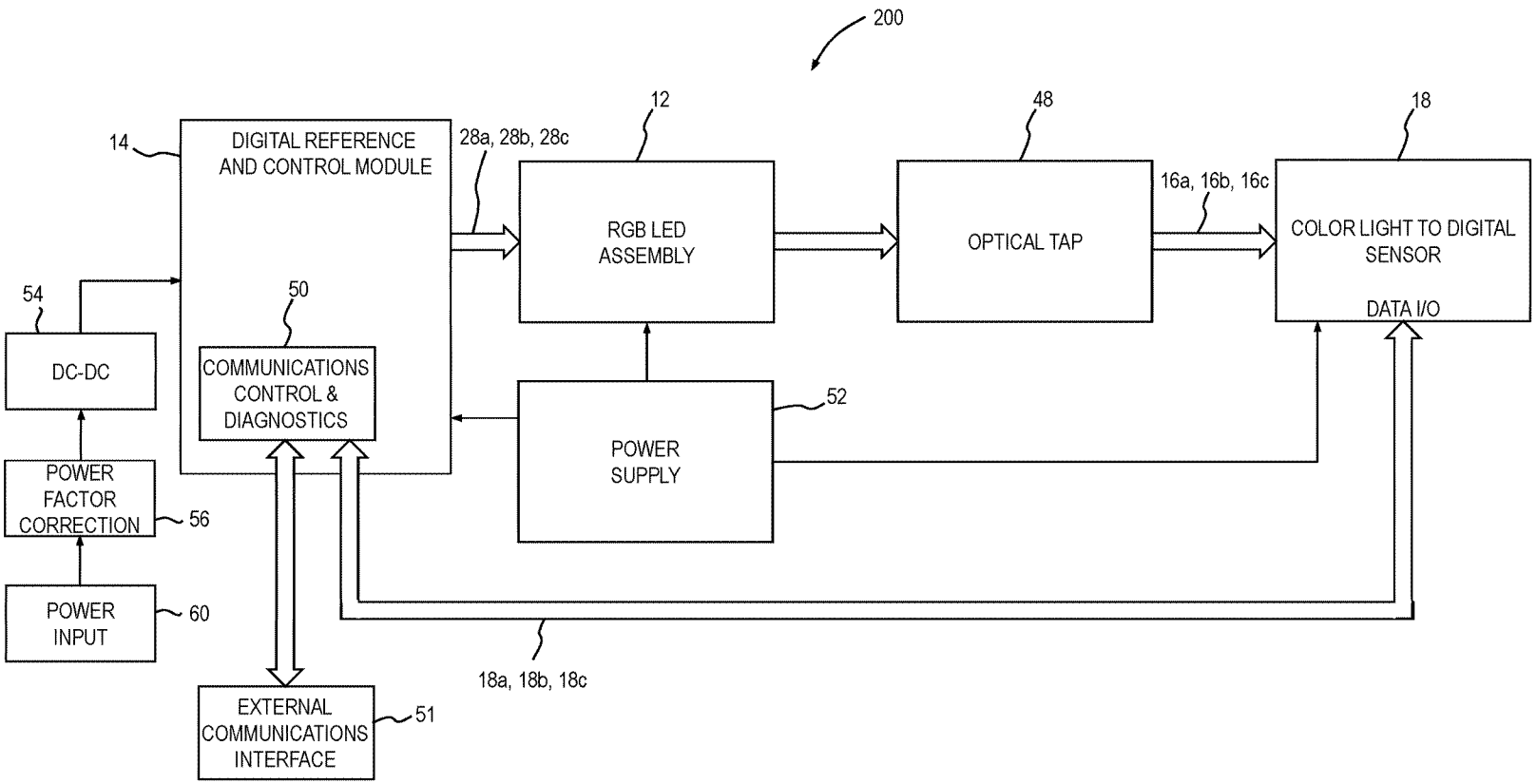
FIG. 7 is a diagram of the general arrangement of an LED light engine according to yet another embodiment of the present invention.
Figure 8:
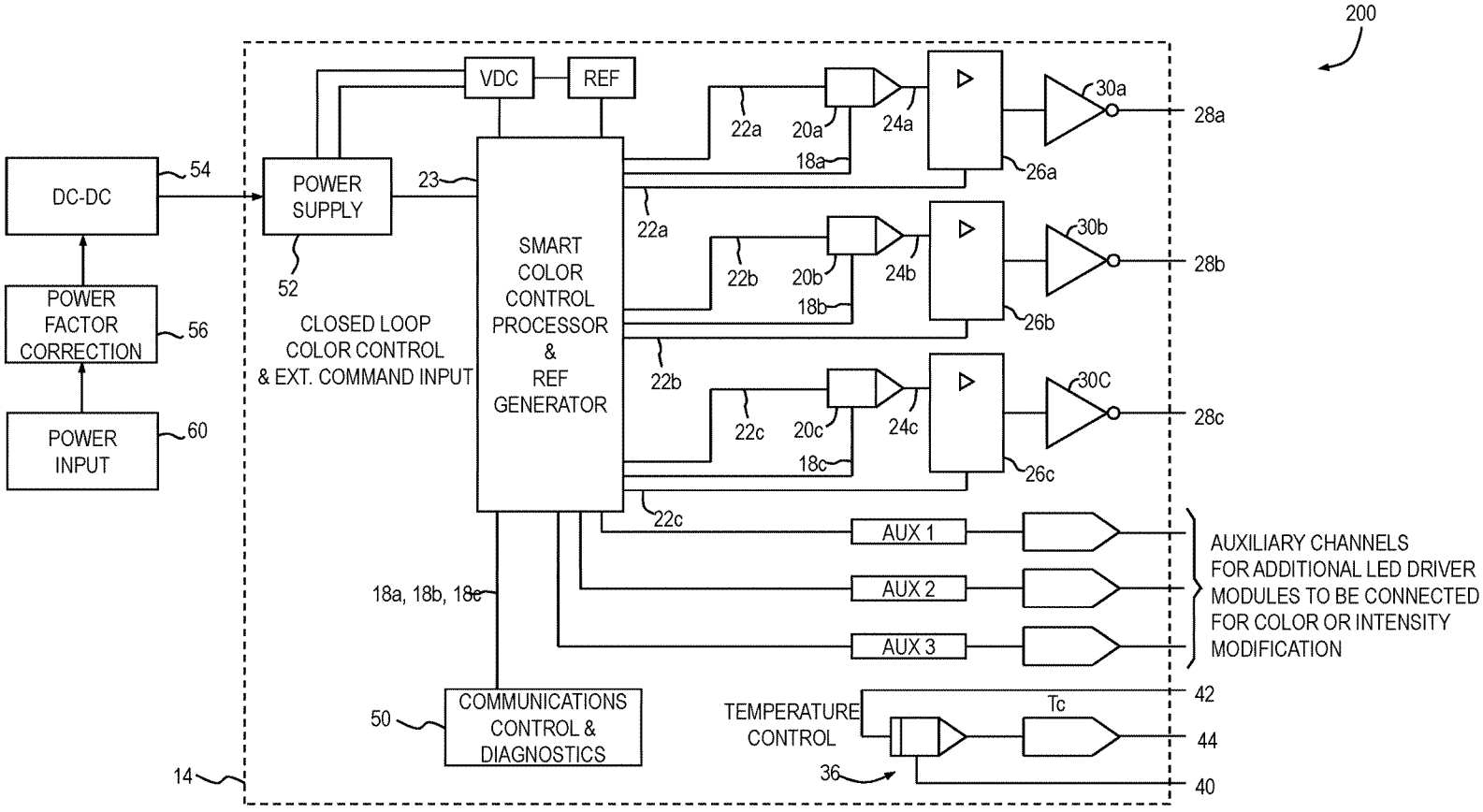
FIG. 8 is a diagram showing further details of the light engine of FIG. 7.

A light engine 200 is shown in FIGS. 7 and 8 according to another embodiment of the present invention. This configuration includes a DC-to-DC converter 54 and a power factor correction control 56, also referred to as "PFC." Additional features may include an analog-to-digital converter (ADC) and LED drive circuitry capable of driving a minimum of three LED 12 strings. Light engine 200 may otherwise be configured in a manner similar to light engine 10, detailed above.

Figure 4:
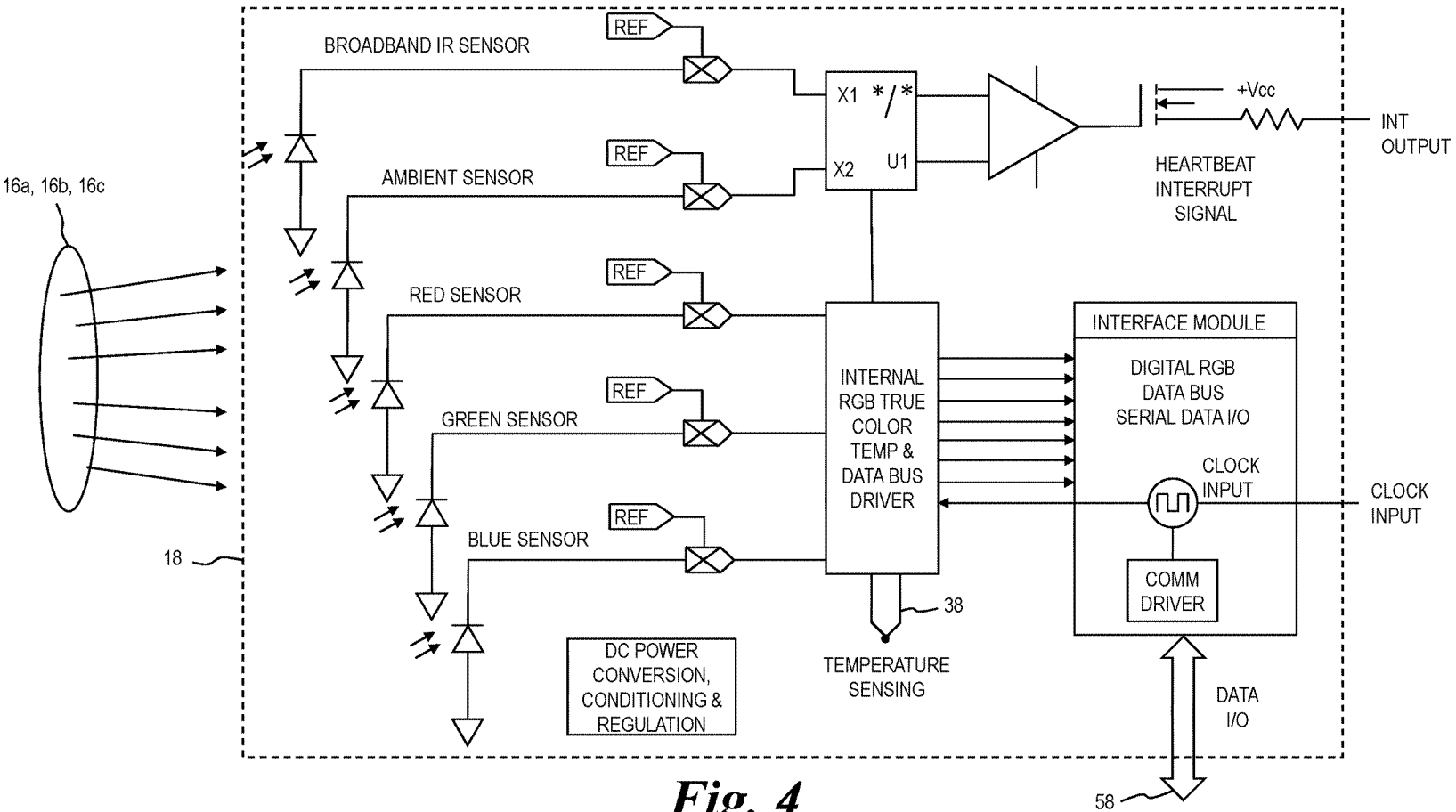
FIG. 4 is a diagram of a light feedback sensor of the light engine of FIG. 1 according to an embodiment of the present invention.

A non-limiting example optical sensor 18 suitable for use with light engines 10, 100, 200 is shown in FIG. 4. Sensor 18 may include such features as, without limitation, true color Red-Green-Blue-Clear (RGBC) and infrared (IR) light intensity sensing, programmable gain, a relatively large dynamic range, and an input-output (I/O) interface 58 such as a serial data interface.

A non-limiting example architecture for communications control 50 of light engines 10, 100, 200 is shown in FIG. 5. In this arrangement digital signal processing (DSP) may be utilized in controller 14 to allow programming of multiple configurations of the light engine. Communications control 50 may further include such features as binary phase shift keying, spread frequency shift keying and orthogonal frequency-division multiplexing. In one embodiment of the present invention communications control 50 may comprise Power Line Carrier Communications (PLC).

Figure 9:
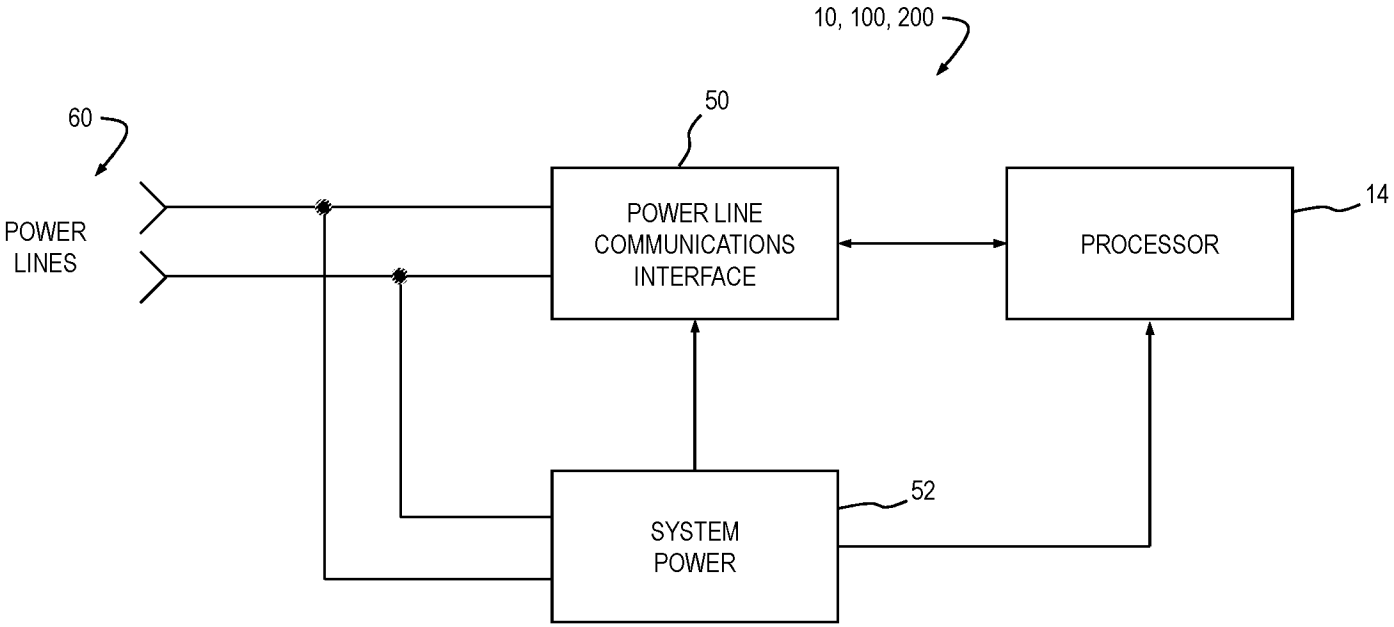
FIG. 9 is a diagram of a remote communications and control arrangement for LEDs according to an embodiment of the present invention.

FIG. 9 further includes input power 60. Input power 60 may be any or all of AC voltage, DC voltage, or constant series current.

Performance specifications for lighting fixtures typically include criteria relating to the color of the light emitted by the fixtures. One measure of light color is the International Commission on Illumination (CIE) 1931 color space chromaticity diagram. The CIE 1931 color spaces are quantitative links between physical pure colors (i.e., wavelengths) in the electromagnetic visible spectrum and physiological perceived colors in human color vision. Most available monochromatic LEDs fall near extreme regions of the allowable color boundaries specified for aviation use. For example, green LEDs usually only have practical sources at the extreme ends of the available products, which requires use of more expensive "binned" devices (i.e., production lots of LEDs that are categorized and sorted based on their measured light emissions or other characteristics). In contrast, the use of RGB-derived colors for LED 12 in the present invention allows opens the field to a much wider range of available colors than is available with monochromatic LEDs, and using less-expensive non-binned LED devices. This wider boundary area also allows for easier color compensation, thereby minimizing color shift in light emitted by the LEDs 12 due to such factors as temperature and aging effects of the LEDs.

Unlike incandescent-based light fixtures, LED lamps do not generate significant amounts of heat. Consequentially, the light output of the LED light fixture can be partially or even fully obscured by snow and ice accumulations upon and around the light fixture. On the other hand, even though incandescent lamps are more capable of defrosting than LEDs, there often arises situations where it is desirable to maintain the lights in a defrosted condition and ready for use without illuminating them. In some embodiments of the present invention controller 14 may include a capability of defrosting LED-based light fixtures during snow and icing conditions, with or without illuminating the LEDs 12. In this embodiment controller 14 (FIG. 1) is coupled to one or more heating elements (not shown) in the light fixtures and selectably controls power to the heating elements separately from LED 12. Controller 14 may also control the amount of heat generated by the heating elements in either an open-loop or a closed-loop control arrangement, which may be similar to temperature regulator 36. Such a system may be expanded by a central or distributed control whereby certain light fixtures are commanded to generate more heat, or the amount of heat is adjusted as needed based upon local sensing at the light fixture. Alternatively, such light fixtures may transmit temperature and other defrosting information through wired (such as power line communication) or wireless communication links so that a main controller can make a decision as where to spread a power load among groups, types or zones of light fixtures in order to reduce energy peaks of a lighting system. Such a "smart" runway lighting control system is thus able to maintain light fixtures in a defrosted condition with less overall power. The "smart" runway lighting control system may also command step changes or internal tap changes to airfield lighting constant current regulators (CCRs) by temporarily commanding the airfield lights to add resistive heater loads for circuit stability.

Selectably controlling LED 12 adds the potential for a number of additional benefits and features, such as visually signaling flight crew personnel of runway status information, for example, potential runway incursions. As another example, airport traffic control signs may be interfaced with sensors that are configured to detect either airborne or ground traffic and, by automatically-set visual cues, signal vehicle operators appropriately to reduce the risk of collision. Similarly, flight crew personnel taxiing about the airport may automatically be given a visual signal via the lighting fixtures, such as by changing the chromaticity or color of the emitted light, to hold short of an active runway when another aircraft is on approach.

Predetermined flashing patterns and/or color changes for LED 12 light sources are thus possible when the light source is reconfigurable to change its characteristics. Examples include, without limitation, changes to the characteristics of stop bars, precision approach path indicators (PAPIs) and helipad lighting when vehicle incursions and out-of-position vehicles are detected. Such light sources may also be reconfigurable to indicate certain landing conditions such as harsh wind conditions. Wind conditions may be detected using a local windsock or microburst detector, and may be indicated with a windsock light or any other relevant airfield light or lights.

A particular advantage of the present invention is that LED 12 can be configured to provide a projected composite beam of light having a color more closely approximating airfield lighting that utilizes incandescent light sources. A typical incandescent lamp provides radiant energy as the result of a filament glowing to a point of incandescence as current passes through it. In applications that require white light, incandescent lamps project a broad spectrum of light that comprises a multitude of wavelengths in the visible-through infrared-light spectrum. The white color is characterized to include all colors such as red, yellow, green, blue and violet, and can be measured to have an equivalent black body temperature between about 2850 and 3250 degrees Kelvin. Dimming the white incandescent light to lower the radiant energy output causes a corresponding decrease in the Kelvin temperature that can be predicted. With the utilization of Red-Green-Blue-Yellow (RGBY) LED 12, color mixing allows light emitted by the present invention to exhibit a nearly incandescent appearance. By precise control of the LED 12 drive current the present invention can control not only the intensity of the LEDs but also their perceived color temperature, which may further be configured with color shift characteristics similar to that of a glowing incandescent filament at lower intensity levels. This corresponds with a decreased color temperature as an incandescent light is dimmed. This feature of the present invention is in contrast to the harsh monochromatic colors currently seen in typical LED lighting fixtures, which do not shift in color as dimming occurs. This feature of the present invention also reduces or eliminates the need for color-shifting optical filters in those applications that also require a color other than white.

Figure 10:
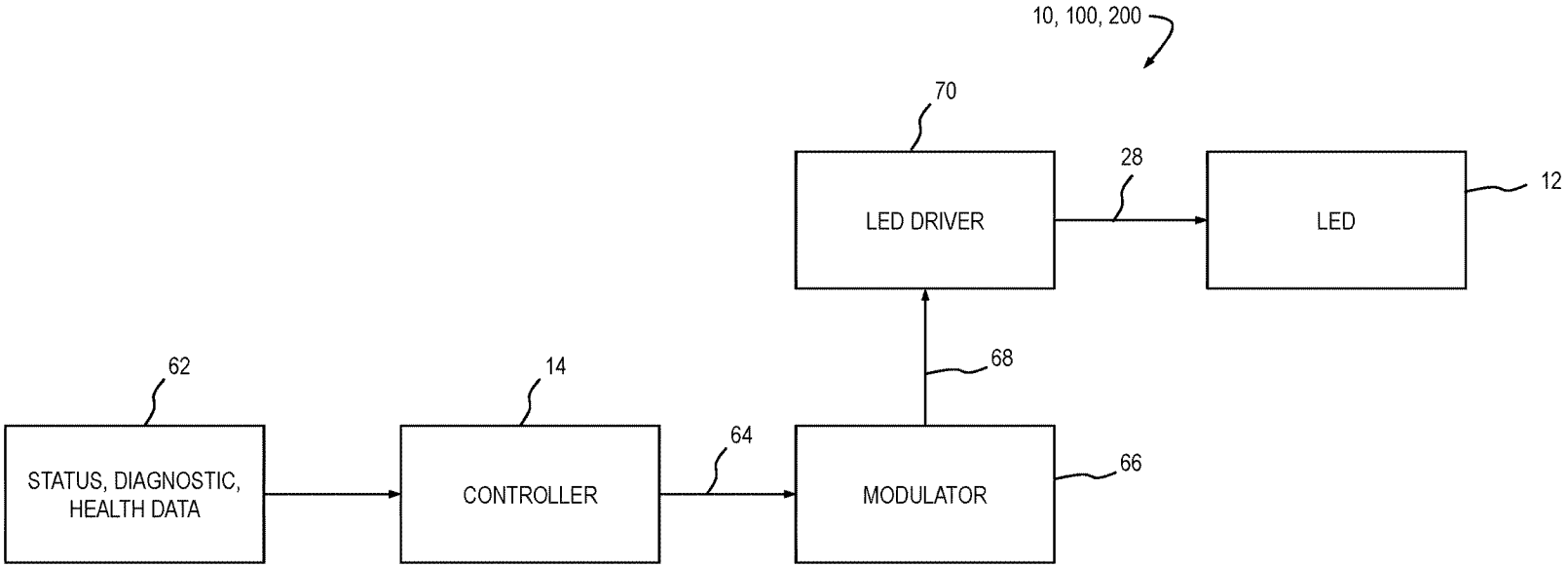
FIG. 10 is a diagram of an arrangement for modulating the light output of an LED light engine with data according to an embodiment of the present invention.

In some embodiments of the present invention light engines 10, 100, 200 may be configured such that predetermined information is modulated upon the light emitted by LED 12. With reference to FIG. 10, as a non-limiting example, status, diagnostic or "health" data 62 relating to various components of the light engine may be provided to controller 14, which encodes the data in a predetermined manner and generates a modulation input signal 64 that is provided to a modulator 66. Modulator 66 receives modulation input signal 64 and provides a corresponding modulation output signal 68 to an LED driver 70, which may be PWM control 26 or a non-PWM based DC current control. The drive signal 28 to LED 12 includes the data 62 modulated thereupon. Light emitted by LED 12 is thus encoded with the data 62.

Figure 11:
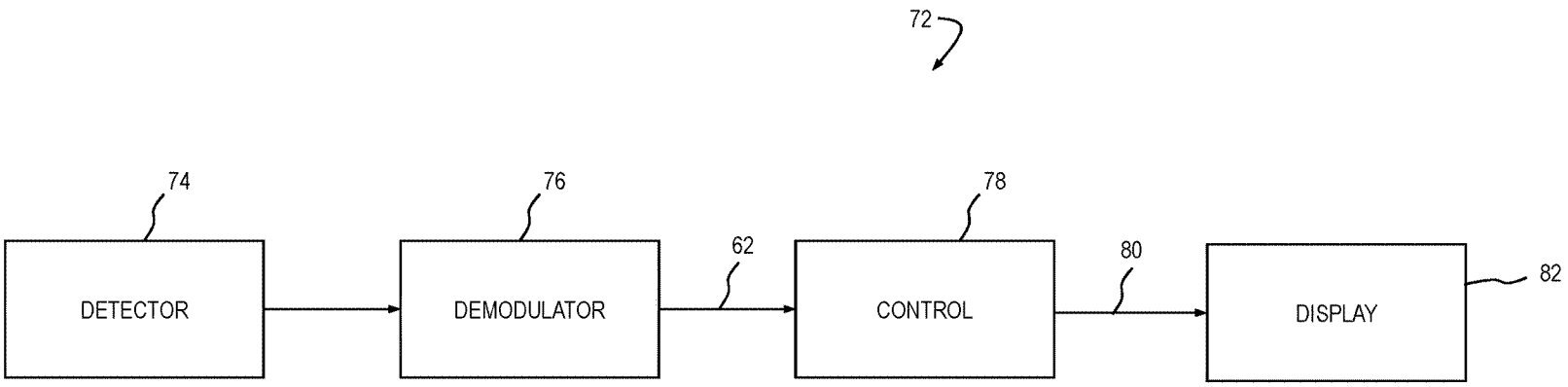
FIG. 11 is a diagram of a receiver to receive and display the data transmitted by the system of FIG. 6.

With reference to FIG. 11, a receiver 72 may be used to retrieve the data 62 encoded upon the light signal emitted by LED 12. A detector 74 receives the light signal and a demodulator 76 extracts data 62 from the signal. A control 78 receives the extracted data 62 and generates a display control signal 80 for display of the data 62 on a display 82. Display 82 may present data 62 in one or more of a visually perceivable, aural and tactile form.

Data 62 may include metrics such as, but not limited to, LED 12 forward voltage $V_f$, light fixture light intensity, system power supply series circuit current, ground resistance, and so on.

The various features described above for each of light engines 10, 100, 200 may be interchangeably utilized in whole or in part or in any other configurations of light engines, within the scope of the invention.

Although the foregoing discussion is presented in the context of aviation lighting, this is merely for the purpose of illustration and is not intended to limit the scope or uses of the invention. One of skill in the art will appreciate that that the disclosed invention is not limited to this field of endeavor and that the disclosed invention may be used to advantage in any number of types or fields of lighting. In addition, from the above description of the invention, those skilled in the art will perceive improvements, changes, and modifications in the invention. Such improvements, changes, and modifications within the skill of the art are intended to be covered.

As can be appreciated from the foregoing discussion, the present invention provides a number of features. The multiple color light engine described allows a light assembly to be adjusted or "tuned" during manufacture for color accuracy. In addition, the light assembly may carry out optical and electrical self-measurements to self-adjust its emitted color during operation to compensate for changes due to LED aging or temperature.

The light assembly may also include wired, wireless or power-line communications for remote monitoring and control. The communications may be utilized, for example, in conjunction with a helipad lighting system to show wind direction by selective control of the light assemblies' emitted color to indicate the wind direction. The communications may also be utilized to effect color changes in the light assemblies to convey predetermined information to flight crews, such as abort-landing signals, runway incursion warnings, and cross/do-not-cross taxiway signals.

The Peltier device discussed above provides a number of features. Firstly, the device may serve to cool LED dies to carry away internally-generated heat and to compensate for elevated environmental temperature conditions. The device may also be used to melt ice accumulations on the light fixture. In addition, heating may be selectably applied to the LEDs by the Peltier device to provide power leveling. Such power leveling provides for more effective remote power-measurement comparison of light fixtures, and may also improve measurement accuracy by facilitating measurements at a predetermined temperature to eliminate temperature-effect inaccuracies. The Peltier device may also be utilized to provide a resistive load to a lighting system during start-up when power is initially applied to the system, the Peltier device acting to provide a stable load for constant current regulators (CCRs) that are often used to power lighting systems.

The assembly described herein may be configured and controlled to meet various lighting needs. For example, some LEDs may be selectively turned on and off to increase or decrease light intensity for high-beam/lo-beam operating modes, which allows for driving LEDs at higher, more accurate PWM duty cycles. The LEDs may also be driven with alternate phasing wherein some portion of the LEDs in the light assembly are always "on" at any given time, thereby reducing perceptible flicker and stroboscopic flicker when the lights are view through a rotating aircraft propeller.

While this invention has been shown and described with respect to a detailed embodiment thereof, it will be understood by those skilled in the art that changes in form and detail thereof may be made without departing from the scope of the claims of the invention.

What is claimed is:

1. A color-controlled light source, comprising:

a plurality of light emitting diodes, the light emitting diodes being configured to emit different colors of light, intensity of the light emitted by the light emitting diodes being selectably adjustable;

a sensor configured to receive the light emitted by the light emitting diodes and convert the received light to electrical feedback signals corresponding to the emitted light;

a processor configured to generate an electrical reference signal;

an amplifier configured to receive the reference signal and the feedback signal, compare the feedback signal and the reference signal, and generate an error signal corresponding to a difference between the feedback signal and the reference signal; and a current control configured to receive the error signal and adjust the intensity of at least one light emitting diode to cancel the error signal, a composite color emitted by the plurality of light emitting diodes having a predetermined, closed-loop controlled chromaticity.

2. The color-controlled light source of claim 1 wherein:

a portion of the plurality of light emitting diodes are configured to emit red light;

a portion of the plurality of light emitting diodes are configured to emit green light; and a portion of the plurality of light emitting diodes are configured to emit blue light.

3. The color-controlled light source of claim 2 wherein the sensor comprises a plurality of sensors, a first sensor being configured to receive red light emitted by the red light emitting diodes and convert the red light to a first electrical feedback signal corresponding to the red light;

a second sensor being configured to receive green light emitted by the green light emitting diodes and convert the green light to a second electrical feedback signal corresponding to the green light; and a third sensor being configured to receive blue light emitted by the blue light emitting diodes and convert the blue light to a third electrical feedback signal corresponding to the blue light.

4. The color-controlled light source of claim 3 wherein the processor is configured to generate a plurality of electrical reference signals, a first electrical reference signal corresponding to the red light;

a second electrical reference signal corresponding to the green light; and a third electrical reference signal corresponding to the blue light.

5. The color-controlled light source of claim 4 wherein the amplifier comprises a plurality of amplifiers, a first amplifier being configured to compare the first electrical feedback signal and the first electrical reference signal, and generate a first error signal relating to the red light;

a second amplifier being configured to compare the second electrical feedback signal and the second electrical reference signal, and generate a second error signal relating to the green light; and a third amplifier being configured to compare the third electrical feedback signal and the third electrical reference signal, and generate a third error signal relating to the blue light.

6. The color-controlled light source of claim 5 wherein the current control comprises a plurality of current controls, a first current control being configured to receive the first error signal and adjust the light intensity of the red light portion of the light emitting diodes to cancel the first error signal;

a second current control being configured to receive the second error signal and adjust the light intensity of the green light portion of the light emitting diodes to cancel the second error signal; and a third current control being configured to receive the third error signal and adjust the light intensity of the blue light portion of the light emitting diodes to cancel the third error signal.

7. The color-controlled light source of claim 1, further including a temperature regulator configured to regulate the temperature of the light emitting diodes.

8. The color-controlled light source of claim 7, wherein the temperature regulator includes a Peltier device to regulate the temperature of the light emitting diodes.

9. The color-controlled light source of claim 1 wherein the current control is a pulse width modulator.

10. The color-controlled light source of claim 9 wherein the pulse width modulator is configured to operate above transonic rotational speed of aircraft propeller tips.

11. The color-controlled light source of claim 9 wherein:

the light emitting diodes are segregated into predetermined sections; and the sections are current-controlled with a plurality of pulse width modulators, an ON-OFF duty cycle of the pulse width modulators being offset with respect to one another.

12. The color-controlled light source of claim 1 wherein a portion of the light emitting diodes are selectably extinguished to dim the light source.

13. The color-controlled light source of claim 1, further including an optical device to at least one of receive, concentrate and direct the light generated by the light emitting diodes in a predetermined manner.

14. The color-controlled light source of claim 1, further including a communications control.

15. The color-controlled light source of claim 14 wherein the communications control comprises power line carrier communications.

16. The color-controlled light source of claim 1 wherein the chromaticity of the emitted light is selectably varied to convey runway status information.

17. The color-controlled light source of claim 1 wherein the emitted light is modulated with predetermined information.

18. The color-controlled light source of claim 1, wherein:

a portion of the plurality of light emitting diodes are configured to emit red light;

a portion of the plurality of light emitting diodes are configured to emit green light;

a portion of the plurality of light emitting diodes are configured to emit blue light;

a portion of the plurality of light emitting diodes are configured to emit yellow light; and the composite color exhibits a varying Kelvin temperature corresponding to an incandescent light source.

19. A color-controlled light source, comprising:

a plurality of light emitting diodes, a portion of the plurality of light emitting diodes being configured to emit red light, a portion of the plurality of light emitting diodes being configured to emit green light, and a portion of the plurality of light emitting diodes being configured to emit blue light, intensity of the light emitted by the light emitting diodes being selectably adjustable;

a plurality of sensors configured to receive the light emitted by the light emitting diodes and convert the received light to electrical feedback signals corresponding to the emitted light, a first sensor being configured to receive red light emitted by the red light emitting diodes and convert the red light to a first electrical feedback signal corresponding to the red light, a second sensor being configured to receive green light emitted by the green light emitting diodes and convert the green light to a second electrical feedback signal corresponding to the green light, and a third sensor being configured to receive blue light emitted by the blue light emitting diodes and convert the blue light to a third electrical feedback signal corresponding to the blue light;

a processor configured to generate a plurality of electrical reference signals, a first electrical reference signal corresponding to the red light, a second electrical reference signal corresponding to the green light, and a third electrical reference signal corresponding to the blue light;

a plurality of amplifiers, a first amplifier being configured to compare the first electrical feedback signal and the first electrical reference signal, and generate a first error signal relating to the red light, a second amplifier being configured to compare the second electrical feedback signal and the second electrical reference signal, and generate a second error signal relating to the green light, and a third amplifier being configured to compare the third electrical feedback signal and the third electrical reference signal, and generate a third error signal relating to the blue light; and a plurality of current controls, a first current control being configured to receive the first error signal and adjust the light intensity of the red light portion of the light emitting diodes to cancel the first error signal, a second current control being configured to receive the second error signal and adjust the light intensity of the green light portion of the light emitting diodes to cancel the second error signal, and a third current control being configured to receive the third error signal and adjust the light intensity of the blue light portion of the light emitting diodes to cancel the third error signal, a composite color emitted by the plurality of light emitting diodes having a predetermined, closed-loop controlled chromaticity.

20. A method for controlling the color of a light source, comprising the steps of:

configuring a plurality of light emitting diodes to emit different colors of light, intensity of the light emitted by the light emitting diodes being selectably adjustable;

receiving the light emitted by the light emitting diodes and converting the received light to electrical feedback signals corresponding to the emitted light;

generating an electrical reference signal;

comparing the feedback signal and the reference signal;

generating an error signal corresponding to a difference between the feedback signal and the reference signal; and adjusting the intensity of at least one light emitting diode to cancel the error signal, a composite color emitted by the plurality of light emitting diodes having a predetermined, closed-loop controlled chromaticity.

* * * * *